US005217402A

United States Patent [19]

Gross et al.

[11] Patent Number: 5,217,402

[45] Date of Patent: Jun. 8, 1993

[54] SOUND PRODUCING WORKBENCH TOY

[75] Inventors: Raymond J. Gross, Culver City; Brett M. Bogar, Torrance; Denise C. Alpine, West Hills, all of Calif.

[73] Assignee: Mattel, Inc., El Sequndo, Calif.

[21] Appl. No.: 832,533

[22] Filed: Feb. 7, 1992

[51] Int. Cl.[5] ..... A63H 33/30; A63H 5/00

[52] U.S. Cl. ..... 446/1; 446/145; 446/397; 446/484; 434/260

[58] Field of Search ..... 446/1, 397, 144, 145, 446/484; 434/259, 260

[56] References Cited

U.S. PATENT DOCUMENTS

| | | | |
|---|---|---|---|
| 2,669,061 | 2/1954 | Orren et al. . | |
| 3,390,483 | 7/1968 | Doe | 446/1 X |
| 4,333,258 | 6/1982 | McCaslin . | |
| 4,348,191 | 9/1982 | Lipsitz et al. | 434/259 X |
| 4,385,762 | 5/1983 | Schwartz | 434/259 X |
| 4,398,892 | 8/1983 | Solomon | 434/259 |
| 4,609,356 | 9/1986 | Gilden et al. | 434/259 |
| 4,692,119 | 9/1987 | Ussery | 434/259 |
| 4,869,701 | 9/1989 | Kawai et al. | 434/259 X |

*Primary Examiner*—Mickey Yu
*Attorney, Agent, or Firm*—Roy A. Ekstrand

[57] ABSTRACT

A sound producing workbench toy includes a molded plastic base supporting a molded plastic work surface. A work station formed of a molded plastic material defines a plurality of receptacles within which various tools and accessories such as simulated nails, screws or bolts may be received. Switch mechanisms within the receptacles are coupled to conventional sound producing circuits and are operative in response to the manipulation of inserted tools, screws, bolts or the like to energize the sound circuits at the appropriate time.

8 Claims, 3 Drawing Sheets

SOUND PRODUCING WORKBENCH TOY

FIELD OF THE INVENTION

This invention relates generally to sound producing toys and particularly to a simulated work environment having sound enhancement.

BACKGROUND OF THE INVENTION

One of the more interesting types of toys which have been provided by practitioners in the art through the years is the type of toy which produces an audible response or sound output. The variety of such sound producing toys is virtually endless and has, in the past, included such things as dolls which speak, cry, sing or make other types of sounds, toy vehicles which provide typical vehicle sounds such as engine noises and screeching breaks, as well as sound producing toys which are adapted to provide a sensory feedback or enhancement action in a learning or amusement environment.

The continuing interest in sound producing toys by consumers has prompted practitioners in the art to develop a great variety of evermore interesting and improved sound producing toys. For example, U.S. Pat. No. 3,390,483 issued to Doe sets forth a SIMULATING SOUNDING TOY in which a base member supports a depressible member resembling a fanciful nail or peg, an aperture for receiving a hammer, and a slot within which a rotatable cogged wheel is supported in alignment with the slot. A simulated saw is provided in combination with the base member. The toy is used by removing the hammer from the base and driving the hammer downwardly upon the simulated peg or nail to produce a sound. In addition, the saw is moved back and forth within the slot of the base to provide corresponding motion of the cogged wheel. A flexible reed and sounding drum are positioned within the base and are operated to produce a sound simulation as the saw moves the cogged wheel vibrating the reed against the drum.

U.S. Pat. No. 2,669,061 issued to Orren, et al. sets forth a MECHANIC SIMULATING TOY WITH SOUND EFFECT in which a base member receives a plurality of threaded bolts in threaded apertures supported upon the base. A corresponding plurality of cogged wheels are secured to the underside of the base and rotatable with the threaded members. A slot and key cooperate to couple the threaded members to the bolts in an operative arrangement. As the bolts are threaded into the workbench, the cogged wheels are rotated which in turn vibrates a reed member producing an audible sound intended to simulate a twisting bolt.

U.S. Pat. No. 4,333,258 issued to McCaslin sets forth an ELECTRONIC TOY having a base member simulating a range top and sink unit in a kitchen environment. Various sounds such as cooking activities or running water are simulated as the base unit is used in an activity pattern which mimics the kitchen activities normally seen by children in observing their parents cooking dinner and so on.

U.S. Pat. No. 4,869,701 issued to Kawai, et al. sets forth an ELECTRICAL EDUCATIONAL TOY generally configured to resemble an animal such as a pony or the like. The appendages and head and neck of the toy are movable and may be removed from the animal body and assembled thereto in a repeatable operation. Sound producing means are operative in response to the relative positions of the appendages to provide learning sounds intended to educate the user as to the proper configuration of the toy.

U.S. Pat. No. 4,348,191 issued to Lipsitz, et al. sets forth an ELECTRONIC BOARD GAME which defines a top surface replicating a farm barnyard area. A plurality of game pieces representative of farm animals or objects typically found in farmyard environments are provided. An electronic circuit produces animal sounds through the game pieces when the game pieces are placed in the proper environment within the board game.

U.S. Pat. No. 4,385,762 issued to Schwartz sets forth an ELECTRONIC MATCHING AND INFORMATION ASSOCIATION GAME in which a set of game pieces having different outlines or otherwise differently configured are engageable into an individual location on a playing surface. A set of display elements each associated with one of the locations may be activated to indicate visibly when a toy is engaged with its associated location. A switch within the location is arranged to operate when the correct configuration piece is engaged and activates or deactivates an associated sound producing device.

U.S. Pat. No. 4,609,356 issued to Gilden, et al. sets forth an REARRANGEABLE FORM BOARD WITH SENSORY FEEDBACK which provides an educational toy having a tray defining a plurality of positions thereon. A plurality of templates are positioned on the tray in a rearrangeable pattern. Each template has a hole therethrough of unique shape and a corresponding plurality of mating male forms are provided. Upon placement of a form into its mating template, a magnet within the base of the form becomes positioned sufficiently close to a reed switch under the tray which is activated thereby and which operates a sound producing circuit within the toy.

U.S. Pat. No. 4,692,119 issued to Ussery sets forth an EDUCATIONAL PUZZLE BOX having a three-dimensional box-like structure which includes a plurality of side portions and cross members selectively connectable to the side portions. A plurality of threaded fasteners and tools are utilized for assembly of the educational device in an assembly which requires a predetermined orientation of the device components to complete assembly.

While the foregoing described prior art devices have provided some increased entertainment and amusement as well as some educational activities for children, there remains a continuing need in the art for evermore improved toy devices.

SUMMARY OF THE INVENTION

Accordingly, it is a general object of the present invention to provide an improved sound producing toy. It is a more particular object of the present invention to provide an improved sound producing toy which simulates several aspects of typical workbench activity. It is a still more particular object of the present invention to provide an improved sound producing workbench toy within which the sound reproduction is realistically coordinated with the motion and activity of the elements within the workbench toy.

In accordance with the present invention, there is provided a sound producing workbench toy comprises: a workbench having a work station defining a plurality of receptacles therein; a plurality of accessory elements insertable into selected ones of the receptacles; a plurality of switches supported within the work station and in operative coupling to the receptacles; and sound producing means coupled to the plurality of switches operative to produce a predetermined sound for the switches.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
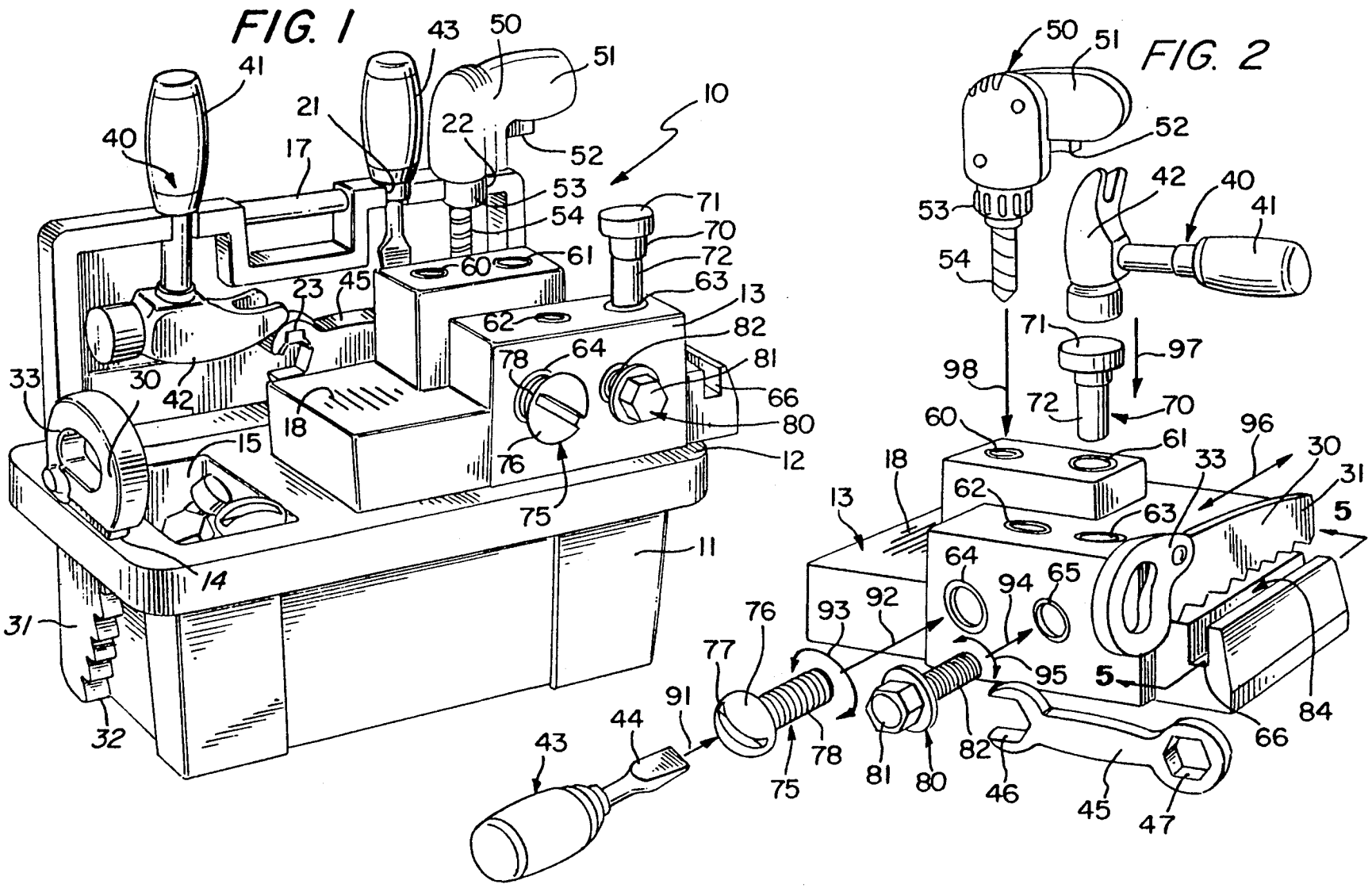
FIG. 1 sets forth a perspective view of a sound producing workbench toy constructed in accordance with the present invention.
FIG. 2 sets forth a perspective assembly view of the operative portion of the present invention sound producing workbench toy.

FIG. 1 sets forth a perspective view of a sound producing workbench toy constructed in accordance with the present invention and generally referenced by numeral 10. Workbench 10 includes a generally rectangular base member 11 which supports a generally planar bench top 12. Bench top 12 defines a recess well 15 and an elongated slot 14. A work station 13 is supported upon bench top 12 of base 11 and defines a multi-faceted housing having an elongated slot 66 along one side thereof and defining an upwardly facing speaker grill 18. Work station 13 further defines a plurality of receptacles 60 through 65. Work bench 10 further includes a vertically supported backboard 16 having a handle 17 defined therein. Backboard 16 further defines a plurality of notches 20, 21 and 22 as well as a support clip 23.

A simulated saw 30 includes a simulated saw blade 31 defining a plurality of simulated saw teeth 32 and a handle 33. Saw 30 is received within slot 14 of bench top 12 for convenient storage. Similarly, a hammer 40 includes a handle 41 and a head 42 and is received within notch 20 for convenient storage. A screwdriver 43 includes a screwdriver blade 44 which is supported within notch 21 for convenient storage. A simulated power drill 50 includes a grip 51, a trigger 52, a simulated drill chuck 53 and drill bit 54. Power drill 50 is stored within notch 22 of backboard 16. A wrench 45 includes an open end 46 which is received upon clip 23 of backboard 16 for support thereof.

In accordance with an important aspect of the present invention, receptacles 60 through 65 as well as notch 66 are configured to interactively receive corresponding ones of the tools shown in workbench 10 and produce appropriate sounds during activity in connection therewith. In the storage position shown, a plurality of simulated screws, nails and bolts are conveniently stored within well 15 while an additional nail 70 is received within receptacle 63. Nail 70 defines a head 71 and a cylindrical shank portion 72. Similarly, a screw 75 having a head 76, a slot 77 defined therein and a threaded shank 78 is threadably received within receptacle 64. In a similar manner, a bolt 80 having a head 81 and a threaded shank 82 is threadably received within receptacle 65.

Figure 3:
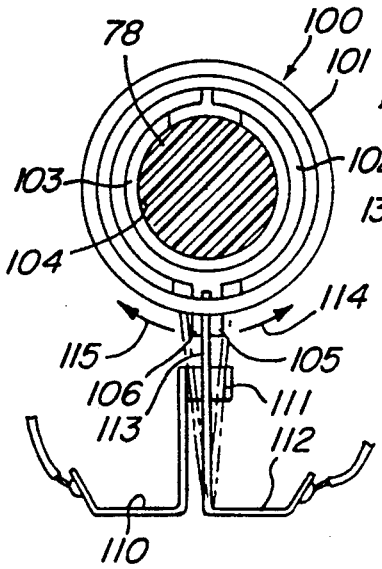
FIG. 3 sets forth a section view of a torsionally operative mechanism of the present invention workbench toy.
Figure 4:
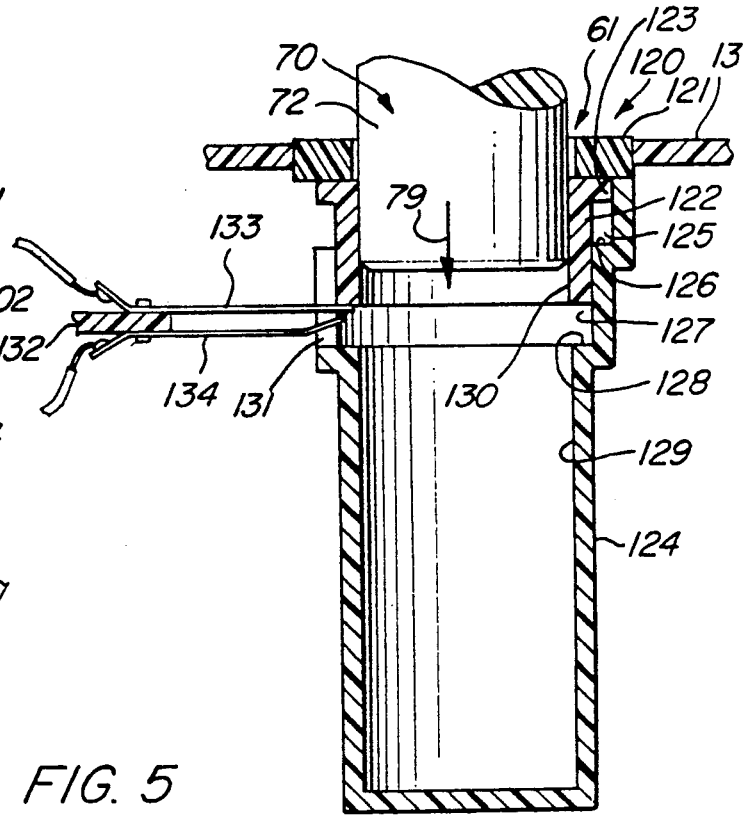
FIG. 4 sets forth a section view of an axially operative portion of the present invention toy workbench.
Figure 5:
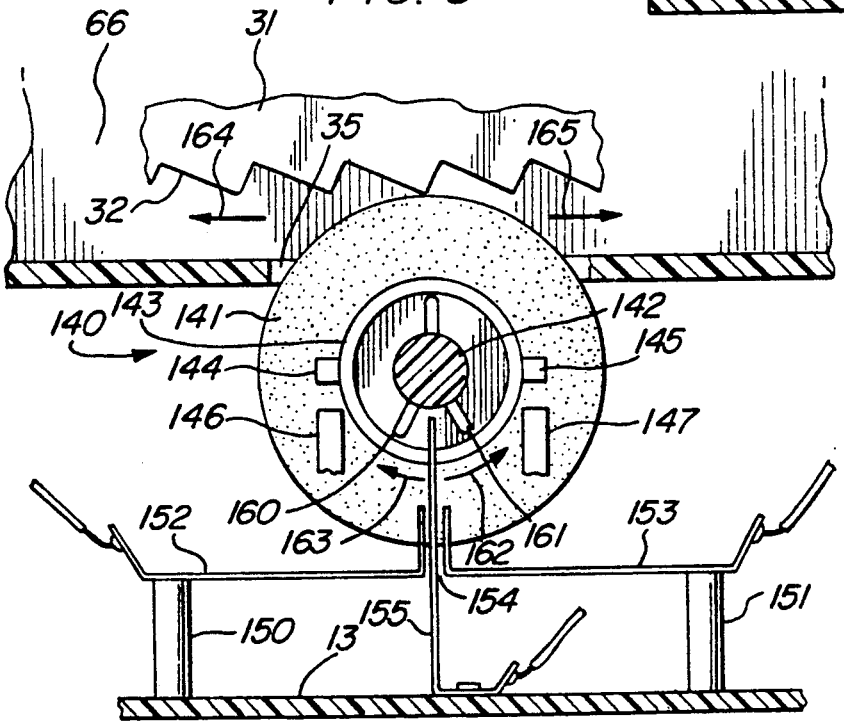
FIG. 5 sets forth a section view of the saw activated portion of the present invention sound producing workbench toy.

FIG. 2 sets forth an assembly view of work station 13 together with associated tools and accessories of workbench toy 10 illustrating their typical use in the play pattern of workbench toy 10. Accordingly, work station 13 defines a plurality of receptacles 60 through 85 as well as an elongated slot 66. Work station 13 further supports a speaker grill 18 and a plurality of sound producing circuits (shown in FIG. 6). In accordance with the present invention, receptacles 60 through 65 support movable switch assemblies which are operated in response to the insertion of a corresponding play element into each receptacle to activate the appropriate sound producing circuit within work station 13. FIGS. 3, 4 and 5 set forth the structures of the switch circuit and the operations thereof are set forth in conjunction therewith in great detail. However, suffice it to note here that each of the plurality of receptacles 60 through 65 as well as slot 66 are intended to cooperate with a corresponding tool or play element to produce a realistic play activity sound.

For example, when saw 30 is positioned in the manner shown in FIG. 2 by the child user grasping handle 33 and orienting blade 31 in general alignment with slot 66 such that teeth 32 face downwardly toward slot 66, the intended play pattern is carried forward by the child user thereafter lowering saw blade 31 into slot 66. Once saw blade 31 is received within slot 66, the back and forth motion of saw 30 in the direction indicated by arrows 96 operates the switch mechanism of FIG. 5 to activate a sound producing circuit within work station 13 (seen in FIG. 6) resulting in the production of sounds which replicate those of a saw cutting wood or the like. Similarly, drill 50 includes a grip 51 within which a movable trigger 52 is supported. Drill 50 further includes a drill chuck 53 and a simulated drill bit 54 extending therefrom. In its preferred form, drill 50 comprises a battery-powered motor driven unit which is activated by trigger 52 to rotate chuck 53 and drill bit 54 to simulate action of a conventional power drill. Thus, in the intended play pattern, drill 50 is lowered in the direction indicated by arrow 98 until simulated drill bit 54 is received within receptacle 60. Once drill bit 54 is received within receptacle 60, the activation of trigger 52 produces a torsional force upon the switch mechanism within work station 13 to energize the appropriate sound producing circuit and produce sounds which replicate the sounds produced by a typical power drill.

Nail 70 includes a head 71 and a cylindrical shank 72 and is insertable into receptacle 61 in the direction indicated by arrow 97. Thereafter, a hammer 40 having a head 42 and a handle 41 is used by the child user to strike head 71 of nail 70 and drive shank 72 downwardly into receptacle 61. During the driving action upon nail 70, the switch mechanism within receptacle 61 set forth in detail in FIG. 4 below is operative to energize the sound circuit within work station 13 which produces a sound replicating that of a nail being driven into a hard material. Receptacles 62 and 63 include similar switch structures to that shown in FIG. 4 and thus receive corresponding nails such as nail 70 in a nail driving action accompanied by the production of nailing sounds.

Receptacles 64 and 65 include torsionally operated switch structures set forth in detail in FIG. 3 below. A threaded screw 75 having a head 76 defining a slot 77 therein and a threaded shank 78 is receivable within receptacle 64 in the direction indicated by arrow 92. Thereafter, screwdriver 43 having a blade 44 is brought into engagement with slot 77 of screw 75 and is turned to thread screw 75 into receptacle 64. During the threading of screw 75 into receptacle 64, the torsionally operated switch within receptacle 64 is operative to energize the appropriate sound producing circuit within workbench 13 to provide sounds corresponding to the threading action of a typical screw. Similarly, a bolt 80 having a hexagonal head 81 and a threaded shank 82 is threadably receivable within receptacle 65 and may be turned therein using wrench 45 in a manner imitating a typical mechanic's operation. The turning of bolt 80 within receptacle 65 provides a torsional force which is operative upon the torsional switch mechanism within work station 13 (seen in FIG. 3) which in turn energizes the appropriate sound producing circuit to provide sounds which are typical of a turning bolt within a threaded hole.

In its preferred form, workbench 10 is fabricated virtually entirely from molded plastic components. Accordingly, work station 13 and base 11 are preferably formed of a molded plastic material. The remaining components of workbench 10 are also preferably formed of molded plastic material and are also preferably configured to avoid injury to the child user. Thus, the components shown in workbench 10 and accessories therefor are preferably formed to be free of sharp edges or the like which might cause injury to the child user.

Thus, the child user is free to engage creatively in the use of workbench 10 by driving one or more nails such as nail 70 into receptacles 61, 62 and 63 or alternatively to thread screws such as screws 75 and bolt 80 into threaded receptacles 64 and 65. In addition, drill 50 may be used to provide a realistic drilling sound while simulating the drilling of a hole within receptacle 60. Finally, the back and forth motion of saw 30 within slot 66 provides realistic sawing sounds which are coordinated with the back and forth motion of saw 30 to improve realism and enhance enjoyment.

FIG. 3 sets forth the torsionally operated switch mechanism supported within work station 13 which is operative in combination with receptacles 64 and 65 as well as drill receptacle 60 and which is generally referenced by numeral 100. Accordingly, torsion switch 100 includes a ring housing 101 within which a threaded member 102 is movable supported. Threaded member 102 is captivated within ring housing 101 in an attachment which permits rotation of threaded member 102 in the directions indicated by arrows 114 and 115. Threaded member 102 defines a plurality of internal threads 103 such as threaded shaft 78 (seen in FIG. 1). Threaded member 102 further defines an extending tab 105 having a slot 106 defined therein. A fixed switch element 110 is supported in proximity to threaded member 102 and ring housing 101 by conventional fabrication means and includes a U-shaped contact 111. A movable switch element 112 is also supported within work station 13 by conventional fabrication means and includes an extending flexible contact 113. Contact 113 passes through U-shaped contact 111 of element 110 and is received within slot 106 of tab 105. Fixed element 110 and movable element 112 form the contact elements of the present invention torsionally operated switches such as switches 80, 84 and 85 (seen in FIG. 6).

Figure 6:
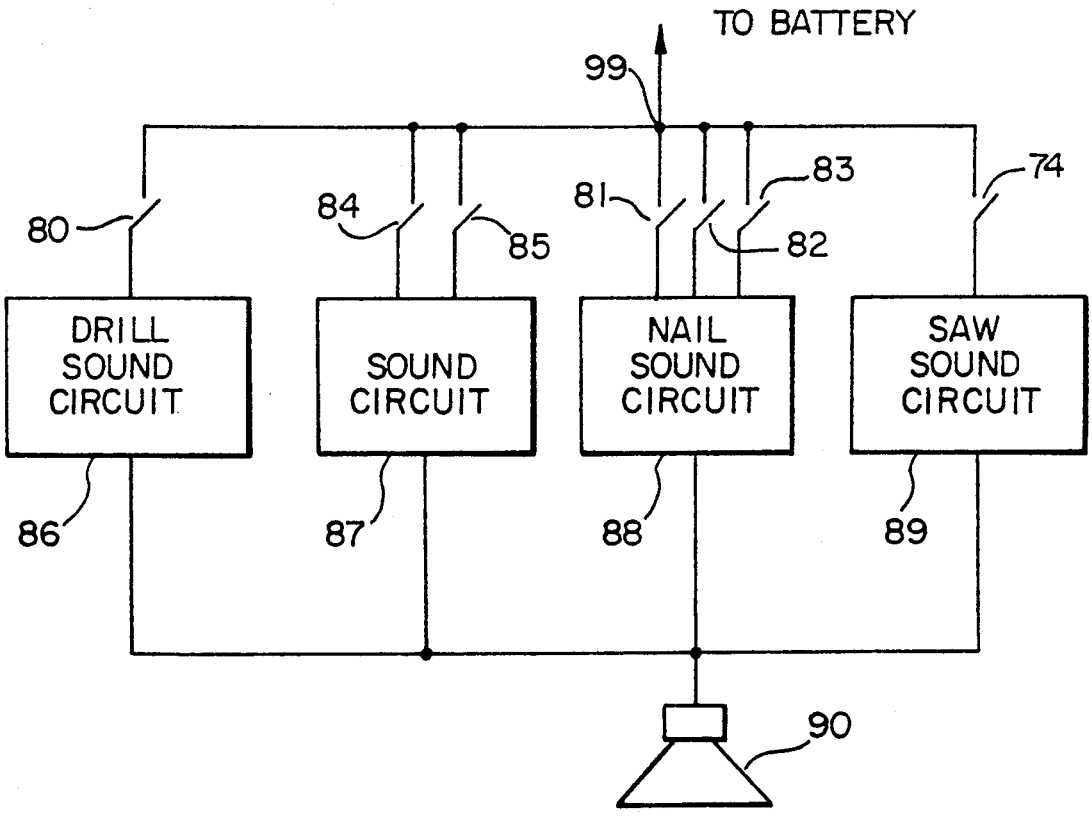
FIG. 6 sets forth a schematic of the electronic circuit of the present invention.

In operation, threaded member 102 receives a rotating play accessory such as threaded shaft 78 of screw 75. Alternatively, it should be understood that threaded member 102 may received threaded shaft 82 of bolt 80 or simulated drill bit 54 of drill 50. The important aspect is that the rotational member such as threaded shaft 78 is received within threaded member 102 in a friction producing engagement such that the turning of the inserted play element produces a torsional force upon threaded member 102. For example, threaded shaft 78 is threadably received within threads 103 of threaded member 102. The relative thread sizes are selected such that frictional engagement is provided therebetween. A similar threaded engagement is provided in the event threads 82 of bolt 80 are received within threaded member 102. Drill bit 54 of drill 50 is sized with respect to minor diameter 104 of threaded member 102 to provide a frictional engagement therebetween which permits the coupling of a torsional force to threaded member 102 when drill 50 is energized. In any event, the application of a torsional force upon threaded member 102 causes a corresponding rotation thereof in either of directions 114 or 115. In either event, the motion of threaded member 102 moves tab 105 which in turn carries flexible contact 113 into contact with one side or the other of U-shaped contact 111 of fixed element 110. The result is the electrical closure of torsional switch 100 which, as is seen in FIG. 6, energizes the appropriate one of the sound producing circuits within work station 13 (seen in FIG. 6). It should be noted that in accordance with an important aspect of the present invention, the structure of torsion switch 100 is that of a momentary type switch. Thus, flexible contact 113 is maintained in contact with U-shaped contact 111 only so long as a torsional force is applied to threaded member 102. Thus, the sound circuit is activated each time and so long as the child user turns the threaded member or rotates drill 50 within torsion switch 100. Thus, the sound character is made more realistic because of its direct association with the child's activities and manipulation of the simulated tools and accessories of the present invention toy.

FIG. 4 sets forth a section view of the switch mechanism used within receptacles 61, 62 and 63 which is generally referenced by numeral 120. Switch 120 is intended to be responsive to the insertion of a simulated nail within its host receptacle and provides the switch structure for switches 81, 82 and 83 (seen in FIG. 6) which are operative within receptacles 61, 62 and 63 respectively. Specifically, switch 120 includes a housing 124 supported within the interior of work station 13 and coupled to a ring member 121. Housing 124 defines a recess 125 terminating in a shoulder 126 and a smaller diameter recess 127 terminating in a shoulder 128. Housing 124 further defines a closed end bore 129. A slide collar 122 defines a generally cylindrical cross section and an interior bore 130. Slide collar 122 further includes an outwardly extending lip 123. Housing 124 also defines a slot 131 within recess 127. A support member 132 coupled to the interior of work station 13 by an attachment not shown supports a pair of electrical contacts 133 and 134. Contacts 133 and 134 are spaced apart and extend into recess 127 through slot 131. Contact 133 extends beneath the lower edge of slide collar 122. In the normal position shown in FIG. 4, contacts 133 and 134 are separated and thus switch 120 is in the open circuit condition. It should be understood that contacts 133 and 134 provide the switch contacts for switches 81, 82 or 83 (seen in FIG. 6), all of which are operative in response to a nailing operation by the child user. Accordingly, the insertion of a shank 72 from nail 70 into receptacle 61 past ring 121 and into slide collar 122 positions nail 70 in a proper configuration to be driven into work station 13. It should be noted that in accordance with an important aspect of the present invention, bore 130 of slide collar 122 is carefully sized with respect to shank 72 of nail 70 to provide a snug friction producing fit which permits slide collar 122 to be carried downwardly in the direction indicated by arrow 79 in response to the friction between shaft 72 and slide collar 122 when nail 70 is struck by the user. It should also be noted that lip 23 captivates slide collar 122 within receptacle 61 beneath ring member 121. In addition, lip 123 cooperates with shoulder 126 to limit the downward travel of slide collar 122 as nail 70 is struck. The downward force upon nail 70 overcomes the spring force of contact 133 and moves nail 70 and slide collar 122 downwardly in the direction of arrow 79 flexing contact 133 downwardly and bringing it into contact with contact 134. As each blow is applied to nail 70, the spring force of contact 133 is overcome and collar 122 is driven downwardly until lip 123 contacts shoulder 126. Each time this happens contacts 133 and 134 are brought to closure activating the sound circuit shown in FIG. 6. In addition, each time lip 123 abuts shoulder 126, further movement of slide collar 122 is precluded and shank 72 is driven through slide collar 122 by some incremental distance. After the blow or impact has ceased as the child user imitates a nailing action described above, the combined spring forces of contacts 133 and 134 overcome the weight of nail 70 and return slide collar 122 and nail 70 to the raised position shown in FIG. 4. It should be understood, however, that because of the sliding motion between shaft 72 and slide collar 122 which takes place due to the interference of lip 123 and shoulder 126 when nail 70 is struck, each impact against nail 70 slides nail 70 downwardly into housing 124 by some incremental distance. The distance of downward movement provided is dependent largely upon the force with which the child user strikes nail 70.

Thus, each time nail 70 is struck, collar 122 is driven downward closing contacts 133 and 134 for a brief moment and producing a nail sound from sound circuit 88 (seen in FIG. 6). As the nailing operation continues, shaft 72 continues to be driven through slide collar 122 and ultimately is received within housing 124 to complete the nailing action. Thereafter, nail 70 may be withdrawn from receptacle 61 and the nailing process repeated.

FIG. 5 sets forth a section view of work station 13 taken along section lines 5—5 in FIG. 2. As mentioned above, work station 13 defines an elongated slot 66 which receives saw blade 31 of saw 30 in the manner shown in FIG. 2. As is also set forth above, saw blade 31 defines a plurality of simulated saw teeth 32. Slot 66 further defines an elongated slot 35 on the lower surface thereof. A switch mechanism generally referenced by numeral 140 includes a wheel 141 having a hub 143 which in turn defines a pair of outwardly extending tabs 144 and 145. Hub 143 is rotatably supported upon a shaft 142 extending transversely to slot 66 within work station 13. Hub 143 defines a pair of angularly separated webs 160 and 161. A pair of limit stops 146 and 147 are positioned within the rotational travel path of tabs 144 and 145 respectively as hub 143 is rotated about shaft 142. Stops 146 and 147 are supported by the interior of work station 13 in accordance with conventional fabrication techniques but which are not shown in FIG. 5. Shaft 142 is positioned with respect to slot 35 such that a portion of wheel 141 extends upwardly therethrough into the interior of slot 66. In its preferred form, wheel 141 is formed of a resilient gripping material such as rubber or foam plastic.

A pair of support bosses 150 and 151 extend upwardly within the interior of work station 13 and support a pair of switch contacts 152 and 153 respectively. Contacts 152 and 153 extend toward each other from support bosses 150 and 151 respectively and terminate in a narrow gap 154. A flexible contact 155 extends upwardly through gap 154 and terminates between webs 160 and 161 of hub 143.

In operation, saw 30 is lowered into slot 66 until teeth 32 of saw blade 31 contact and engage the raised portion of wheel 141. Thereafter, saw blade 31 is moved in either direction causing a corresponding angular motion of wheel 141. For example, on a forward stroke of saw 30, saw blade 31 moves in the direction indicated by arrow 165 which in turn causes a rotational motion of wheel 141 in the direction indicated by arrow 163. As wheel 141 rotates in the direction of arrow 163, web 161 is forced against flexible contact 155 carrying it in the direction of arrow 163 and into contact with contact 152. Correspondingly, the rotation of wheel 141 in the direction of arrow 163 is limited by the interference of tab 145 against stop 147. However, the flexing of contact 155 against contact 152 completes one segment of switch 140 which in accordance with the sound producing circuit of FIG. 6 activates switch 84 and produces a sawing sound.

Conversely, as saw blade 31 is drawn within slot 66 in the direction of arrow 164, wheel 141 is rotated in the direction of arrow 162 causing web 160 to carry flexible contact 155 into contact with switch contact 153. The rotational motion of wheel 141 is limited by the interference of tab 144 against stop 146. Once again, the contact between flexible contact 155 and contact 153 causes closure of switch 140 activating the corresponding sound circuit (seen in FIG. 6).

This operation of switch 140 continues and as the child user moves saw blade 31 back and forth within slot 66, the engagement of teeth 32 with wheel 141 causes wheel 141 to be rotated back and forth thereby closing switch 140 first in one direction and then the other. Thus, switch 140 provides the capability for closing one segment of switch 140 during one stroke of saw blade 31 in the direction of arrow 165 and closing an alternate section of switch 140 as saw blade 31 is drawn in the opposite direction indicated by arrow 164. This permits switch 140 to operate its sound circuit in a more realistic manner since realistic sawing sounds require a different sound in the forward and return strokes of the sawing motion.

FIG. 6 sets forth a block diagram of the switch connections and sound circuits of the present invention sound producing toy. Accordingly, a sound circuit 86 which in accordance with conventional fabrication techniques produces a drill sound is coupled between a speaker 90 and a battery connection 99 through a switch 80. Thus as switch 80, which as mentioned above, is configured in the manner of FIG. 3 is closed, sound circuit 86 is activated by the connection to battery connection 99 to provide drill sounds which are applied to speaker 90. Similarly, sound circuit 87 includes conventional sound producing circuitry for providing one or more sounds typical of the turning action of a threaded member such as a screw or bolt within a tight threaded aperture. Sound circuit 87 is energized by the closure of either of switches 84 or 85 which are also configured in the manner shown in FIG. 3.

Sound circuit 88 includes conventional sound producing circuitry which provide the sounds typical of a nail being driven through a hard material. Sound circuit 88 is energized by the closure of any of switches 81 through 83 which are configured in the manner shown in FIG. 4. Sound circuit 89 includes conventional sound producing circuitry for providing sounds replicating a sawing action by a saw upon a board or the like and is coupled to battery connection 99 by a switch 74 which is configured in the manner shown in FIG. 5.

Thus, in operation, the circuit of FIG. 6 is operated as each of the switch mechanisms described above is closed by the child user's manipulation of the corresponding tool or accessory to energize the appropriate sound circuit from among sound circuits 86, 87, 88 and 89 to produce audible output sounds at speaker 90 in a realistic manner.

What has been shown is a novel sound producing workbench toy in which a plurality of typical working sounds are provided as the child user engages a variety of accessories and simulated tools in a play pattern which duplicates the workbench activities with which the child is familiar.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A sound producing workbench toy comprising:

a workbench having a work station defining first and second pluralities of receptacles therein;

a first plurality of accessory elements removably insertable into selected one of said first plurality of receptacles each configured to replicate a threaded fastener;

a first plurality of switches rotatably actuated and supported within said work station and in operative coupling to said first plurality of receptacles; and first sound producing means coupled to said first plurality of switches each operative to produce a predetermined sound for each of said first plurality of switches.

2. A sound producing workbench toy as set forth in claim 1 further including:

a second plurality of accessory elements removably insertable into selected ones of said second plurality of receptacles each configured to replicate a driven type fastener;

a second plurality of switches linearly actuated and supported within said work station and in operative coupling to said second plurality of receptacles; and a second sound producing means coupled to said second plurality of switches each operative to produce a predetermined sound for each of said second plurality of switches.

3. A sound producing workbench toy as set forth in claim 2 wherein said work station defines an elongated slot and surrounding channel and wherein said workbench toy further includes:

a wheel rotatably supported upon said work station beneath said slot and extending partially through said slot;

a wheel switch coupled to said wheel and actuated by rotation thereof;

third sound producing means coupled to said wheel switch for producing a sawing sound; and a toy saw having a toothed blade partially receivable within said channel to rotate said wheel in a sawing motion.

4. A sound producing workbench toy as set forth in claim 3 wherein said first plurality of accessory elements includes externally threaded fasteners and wherein said first plurality of switches includes cooperating internally threaded actuating elements.

5. A sound producing workbench toy as set forth in claim 4 wherein said second plurality of accessory elements includes toy nails having shank portions and wherein said second plurality of switches includes cooperating sleeve portions receiving said shanks.

6. A sound producing workbench toy as set forth in claim 5 further including a toy hammer for driving said toy nails.

7. A sound producing workbench toy as set forth in claim 4 further including a toy screwdriver for engaging at least one of said externally threaded fasteners.

8. A sound producing workbench toy as set forth in claim 7 further including a toy wrench for engaging at least one of said externally threaded fasteners.

* * * * *